US005097694A

United States Patent [19]

Haennit et al.

[11] Patent Number: 5,097,694

[45] Date of Patent: Mar. 24, 1992

[54] METHOD AND APPRATUS FOR BENDING SHEET METAL PIECES

[75] Inventors: Eduard Haennit, Zofingen; Vaclav Zbornik, Oftringen, both of Switzerland

[73] Assignee: Haemmerle AG, Brugg, Switzerland

[21] Appl. No.: 438,516

[22] Filed: Nov. 17, 1989

[30] Foreign Application Priority Data

Nov. 21, 1988 [AT] Austria ..... 2842/88

[51] Int. Cl.[5] ..... B21D 5/01

[52] U.S. Cl. ..... 72/389; 72/465

[58] Field of Search ..... 72/389, 465, 448, 412

[56] References Cited

U.S. PATENT DOCUMENTS

| | | | |
|---|---|---|---|
| 4,014,204 | 3/1977 | Hanni et al. | 72/465 |
| 4,016,742 | 4/1977 | Shiokawa | 72/465 |
| 4,063,445 | 12/1977 | Haenni et al. | 72/389 |
| 4,106,323 | 8/1978 | Haenni et al. | 72/389 |

FOREIGN PATENT DOCUMENTS

| | | | |
|---|---|---|---|
| 0000417 | 1/1979 | Japan | 72/389 |

*Primary Examiner*—David Jones

*Attorney, Agent, or Firm*—Tarolli, Sundheim & Covell

[57] ABSTRACT

The invention provides a method of bending a sheet metal piece by means of a bending apparatus. The bending apparatus comprises a bending bar, a bending bar holder, a bottom die comprising an adjustable die bottom and a bending bottom die holder. The method of the invention is particularly suitable for bending sheet metal pieces which are shorter than the bending bar and the bending bottom die. In order to compensate for irregularities during the bending, the regions of the bending bar and bending die, respectivley, which are not influenced by the reactive forces of the sheet metal piece to be bent, are under the influence of compensating members bridging the air gap resulting between bending bar and bending die. Thus, the bending press is evenly loaded and the sheet metal work piece can be bent into an exactly predetermined bending angle.

10 Claims, 4 Drawing Sheets

METHOD AND APPRATUS FOR BENDING SHEET METAL PIECES

BACKGROUND OF THE INVENTION

1. Field of the Invention

The present invention refers to a method of bending sheet metal pieces by means of a bending apparatus comprising a bending bar, a bending bar holder, a bottom die cooperating with said bending bar and including a die bottom which is adjustable in height, and means for receiving and supporting said bottom die, whereby said bottom die and said means for receiving and supporting said bottom die, respectively, or said bending bar and said bending bar holder, respectively, are provided with a number of plunger-cylinder units arranged side by side.

Further, the invention relates to an apparatus for bending sheet metal pieces comprising a bending bar, a bending bar holder, a bottom die cooperating with said bending bar and including a die bottom which is adjustable in height, and means for receiving and supporting said bottom die, whereby said bottom die and said means for receiving and supporting said bottom die, respectively, or said bending bar and said bending bar holder, respectively, are provided with a number of plunger-cylinder units arranged side by side.

2. Prior Art

For bending sheet metal pieces, use can be made of folding presses which, generally, comprise a movable bending bar and a bottom die placed in a bottom die holder. During bending of a sheet metal piece, high forces are required to bend the sheet metal piece, depending on the thickness of the sheet metal piece. Thereby, the thus resulting high working pressures require a heavy construction of the folding press in order to prevent a deflection of the frame of the press. However, it became apparent that deflection of the press frame cannot be avoided. It is obvious that such deflections affect the precision of the bending process. Consequently, attempts were made to avoid or to compensate such possible deflections.

One proposal of Applicant was to use a work table which rests on a supporting element having the same length as the work table. The supporting element is vertically shiftably beared in a bottom part on an oil cushion. Thereby, a possible deflection of the press frame can be compensated for during bending heavy sheet metal pieces.

A further embodiment of such a folding press, based as well on a proposal of the applicant, consisted in placing the bottom die holder on a plurality of plunger-cylinder units lined up side by side. This method also allows a compensation for possible deflections of the press frame when bending heavy workpieces.

However, if the work piece to be worked is shorter than the available length of the work table, particularly considerably shorter, the work piece is too much pressed at its ends, and inexactnesses will arise there, even if the work table rests on an oil cushion or on a plurality of plunger-cylinder units.

A more precise working is provided by a folding press in which the elastically yieldingly supported tool itself or its support is composed by a number of partial elements which are arranged side by side and which are individually vertically displaceable. If under load, only those partial elements which are directly or indirectly supporting the work piece are displaced towards the elastic support. With such a folding press it is favourable to support the bottom die holder by a number of plunger-cylinder units arranged side by side, whereas the bottom die is provided with an adjustable die bottom so that by adjusting the height position of said bottom any desired bending angle can be preselected.

Further, it has been proposed to design a folding press in such a manner that the upper or the lower tool assembly, respectively, is supported by the plungers of a plurality of vertical hydraulic supporting cylinders which are secured to the upper or the lower tool assembly, respectively, and are distributed over the length of the folding press. Said supporting cylinders are linked so as to form a closed hydraulic system.

However, this design has several disadvantages. Particularly, a precise bending of a workpiece to different bending angles is not possible without more ado. If the sheet metal piece to be bent is shorter than the bending bar or the bending bottom die, respectively, the stability of the bending process is endangered, and single-sided loadings will occur.

OBJECTS OF THE INVENTION

It is an object of the invention to provide for a method and an apparatus for producing an uniform bending force for any bending angle.

It is a further object of the invention to provide for a method and an apparatus for bending sheet metal pieces which are considerably shorter than the bending bars or the bending bottom dies, respectively.

It is a further object of the invention to provide for a method and an apparatus for working extremely narrow sheet metal strips with great precision without producing single-sided dislocations or instabilities, respectively.

SUMMARY OF THE INVENTION

In order to meet these and other objects of the invention, according to a first aspect of the invention, there is provided a method of bending narrow sheet metal pieces by means of a bending apparatus to a precisely predeterminded bending angle. The method makes use of a bending apparatus which comprises a bending bar, a bending bar holder, a bottom die cooperating with said bending bar and including a die bottom which is adjustable in height, and means for receiving and supporting said bottom die, whereby said bottom die and said means for receiving and supporting said bottom die, respectively, or said bending bar and said bending bar holder, respectively, are provided with a number of plunger-cylinder units arranged side by side.

This method is characterized as follows:

The still flat sheet metal work piece is placed on the top of the bottom die which is provided with a longitudinal groove. The sheet metal work piece will be pressed into the groove of the bottom die such that it is bent to a certain predetermined angle. This pressing the sheet metal work piece into the groove of the bottom die, under the influence of the bending bar moving towards the groove of the bottom die and, thereby, towards the sheet metal work piece, performs an initial bending of the sheet metal work piece to a certain bending angle which is not yet the finally desired bending angle.

As previously mentioned, the bottom die has an adjustable die bottom. During the bending operation, the leading edge of the bend in the sheet metal work piece finally will abut against the adjustable die bottom. With other words, during the aforementioned, the sheet metal work piece is freely bent to a certain angle greater than the finally desired bending angle, i.e. before said leading edge of the bend abuts against said adjustable die bottom which finally determines the bending angle. This initial bending operation is called "air bending" as is well aware to any person skilled in the art.

After termination of air bending said sheet metal piece, which is shorter than said bending bottom die and said bending bar, the sheet metal work piece, is uniformly deformed along the elastic line of the edge of said bending bar and said die bottom, respectively, by cooperation of those of the plunger-cylinder units which are situated in the area of said sheet metal piece with said bending bottom die or said bending bar.

At the same time, the plungers of the two plunger-cylinder units which are arranged in the left and right outermost positions outside the area of said sheet metal piece are forced to abut against stops. These stops are bridging the air gaps caused by the sheet metal piece missing at these places between said bending bar and said die bottom, and still at the same time, the remaining plungers, if situated outside said area of the sheet metal piece, are discharged.

According to a variant, the method further comprises the steps of:

keeping said plunger-cylinder units unpressurized in the lower and the upper dead centre positions, respectively, during air bending;

stopping said bending bar after air bending shortly before reaching said die bottom; and pressurizing those of the plungers of the plunger-cylinder units which are situated below and above the sheet metal piece, respectively, as well as the outermost plungers, in order to press said bending edge against said die bottom and to press said two outermost plungers against said stops.

In both variants, it is essential that the sheet metal piece is continuously and under constant pressure pressed against the die bottom. This ensures a constant bending angle over the whole length of bending, independently whether the length of sheet metal is equal to or is shorter or even much shorter than the length of the bending bar. The pressure of some of the plunger-cylinder units is varied only for compensation of local irregularities of the structure of sheet metal and of its mechanical and strength properties, respectively.

In a preferred embodiment of the invention, the die bottom is raised by the amount of the thickness of said sheet metal in the area of the outermost left and right plunger-cylinder units if said plunger-cylinder units are arranged outside the area of the sheet metal piece.

Instead of raising the die bottom, the same effect can be produced by lowering the corresponding segments of the bending bar, i.e. those segments which are situated in the area of the outermost left and right plunger-cylinder units, if the sheet metal piece is narrow, and if there is no sheet metal present in the area of said outermost plunger-cylinder units.

In both cases, the air gap existing at both ends of the bending bar between the bending bar and the bottom die is bridged, either by raising the bottom of the bending bottom die, or alternatively, by lowering the corresponding segments of the bending bar, so that the great forces present in the bending process cannot cause any instabilities. The remaining units which are also situated outside the area of the sheet metal piece are discharged.

According to a second aspect of the present invention, there is provided an apparatus for executing the above method described. This apparatus is comprising:

a bending bar holder;

a bending bar;

a bending bottom die holder;

a bending bottom die placed in said bottom die holder and comprising an adjustable die bottom;

a number of plunger-cylinder units which are arranged side by side and are controllable and can be pressurized independently from each other, said bending bottom die holder or said bending bar or said bending bar holder, respectively, being supported, either directly or by means of an intermediate work table, by said plunger-cylinder units; and adjusting members arranged at both ends of said bending bar and adjustable to the thickness of the sheet metal piece, in order to bridge the air gap corresponding to said thickness of said sheet metal piece.

As explained above, any local irregularities of the structure of sheet metal and of its mechanical and strength properties, respectively, can be compensated for by applying different pressures at such places. This is done by increasing or decreasing the working pressure for the plunger-cylinder units situated in the areas of such irregularities. In this manner, a perfect bending angle is produced, even if there are irregularities in the structure of the sheet metal work piece to be worked.

BRIEF DESCRIPTION OF THE DRAWINGS

In the following, the method and the apparatus will be further explained in detail with reference to the accompanying drawing, in which.

DETAILED DESCRIPTION OF PREFERRED EMBODIMENTS

Figure 1:
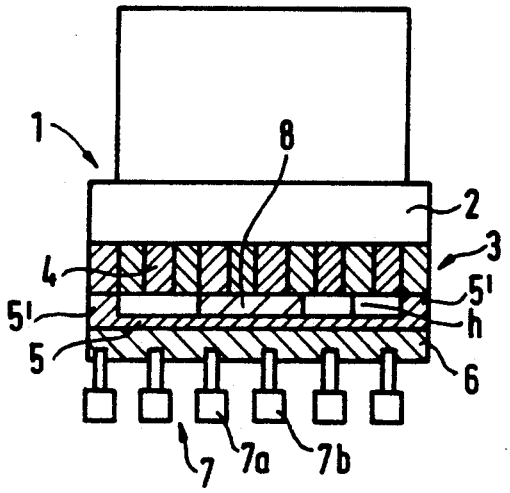
FIG. 1 is a diagrammatic view of a folding press for executing the method of the invention.

According to FIG. 1, the apparatus used to perform the method of the invention is a folding press 1 comprising a hydraulically operated ram 2, which for its part comprises a bending bar 3. The bending bar 3 is either undivided or composed of single and individual segments 4. By adding or eliminating some of segments 4, it is possible to vary the length of the bending bar 3. The bending bar 3 is cooperating with a bending die 5 which is arranged in a bottom die holder 6 and comprises a die bottom the elevation or height position of which is adjustable and which is also composed of single segments. This bottom die will be described and explained more in detail with reference to FIG. 4. In this embodiment, the bottom die holder 6 is supported by a number of plunger-cylinder units 7 which are lined up side be side and are operated independently or jointly, as will be described later.

In the embodiment purely diagrammatically shown in FIG. 1, a sheet metal piece 8, which is very narrow as compared with the length of the ram 2, is inserted between the bending bar 3 and the bottom die 5. The thickness h of the sheet metal piece 8 is obviously not greater than a few millimeters, but is shown in the drawing in much exaggerated scale for explanation of the problems. The two plunger-cylinder units 7*a*, 7*b* are arranged below the sheet metal piece 8.

For working the sheet metal piece 8, the plunger-cylinder units 7 are pressurized before the bending process starts, with a pressure which is higher than the air bending force necessary for bending the sheet metal work piece. The term "air bending force" denotes the force which is necessary for initially deforming the sheet metal piece 8 which at the beginning is flatly supported by the grooved bottom die 5 and is then pressed into the groove of the bottom die 5.

This air bending force is the pressing power necessary for deforming the sheet metal piece 8 until it touches the bottom of the bottom die 5. When the leading bent edge of the sheet metal work piece has reached the die bottom and abuts thereagainst, this latter puts up resistance and more bending force is required to be performed by the bending bar. Consequently, this causes an increase of the pressing power to be effected. Previously, the elevation adjustable die bottom is adjusted in function of the desired bending angle by adjustable taper keys, as is known in the art.

After termination of air bending, when the leading bent edge of the sheet metal piece 8 has reached the bottom of bottom die 5, the pressing power is increased in any desirable manner known to any person skilled in the art as a consequence of the resistance put up by the plunger-cylinder units 7, so that the plunger-cylinder units 7*a* and 7*b* arranged below the sheet metal piece 8 are pressed back. Bending of the sheet metal work piece now takes place under uniform pressure along the elastic line of the edge of the bending bar 3.

If—as mentioned above—the sheet metal piece 8 is much narrower than the bending bar 3 and the bottom die 5, an instability arises when the bending edge of sheet metal piece 8 reaches the bottom of the bottom die 5, since outside the area of the sheet metal piece 8 an air gap is present and no resistance or counterforce against the bending bar 3 is put up. In order to remedy this disadvantage, in the embodiment of FIG. 1, the bottom of the bottom die 5 is raised at both ends 5' by an amount equal to the metal sheet thickness. By this, the air gap at both ends of the bottom die 5 is bridged, and the bending bar 3 is firmly supported not only in the locations where the sheet metal work piece is present, but also outside the region thereof. Said raise of the die bottom at both ends of the bottom die 5 is effected by separate taper keys (not shown), which are actuatable by adjusting spindles. Preferably, these spindles are motor driven and precisely adjusted. This arrangement will be described later.

Figure 2:
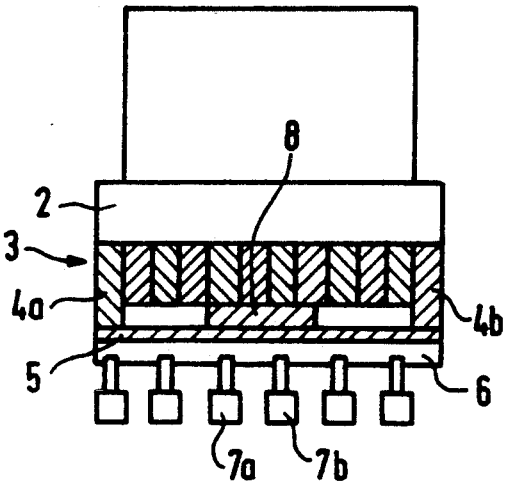
FIG. 2 is a diagrammatic view of a variant of such a folding press.

Another embodiment of the invention is shown in FIG. 2. (Reference numbers which are not specifically described are corresponding to the items described with reference to FIG. 1.). This embodiment also comprises a bottom die 5 and a bottom die holder 6. For working a sheet metal piece 8, which e.g. is identical with the sheet metal piece shown in FIG. 1, it is processed exactly as described with reference to FIG. 1, except that for stabilizing the bending bar 3 the two outer segments 4*a*, 4*b* of the bending bar 3 are lowered by the amount of the sheet thickness h.

Figure 3:
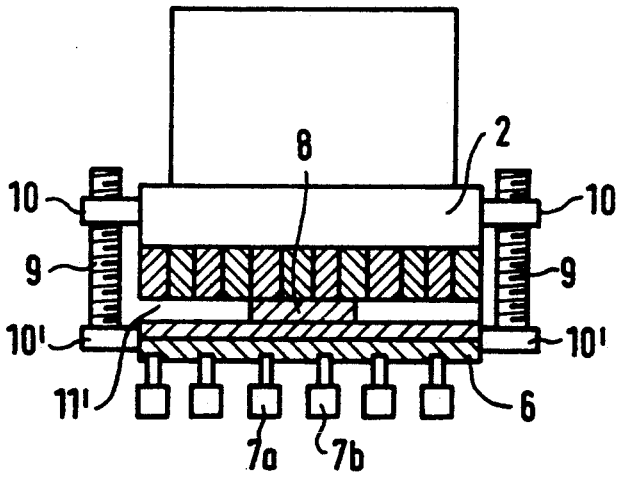
FIG. 3 is a diagrammatic view of a preferred embodiment of such a folding press.

A further embodiment of the invention is shown in FIG. 3. (Here too, reference numbers which are not specifically described are corresponding to the items described with reference to FIG. 1.). In this embodiment, the folding press is provided at both ends with threaded spindles 9, said threaded spindles 9 being arranged on the left and the right, respectively, of a ram 2 and being adjustable in holding members 10 which are fixed to said ram 2. Below said threaded spindles 9, stops 10' which are synchronously movable together with the die bottom are arranged on both sides of a bottom die holder 6. The threaded spindles 9 act against said stops 10' and are adjusted so as to create on both ends of the bending bar 3 an air gap 11' the height of which is corresponding to the sheet thickness h.

In all three embodiments, the remaining plunger-cylinder units, which are also arranged outside the area of the sheet metal piece 8, are discharged, i.e. are not pressurized.

The same effect can be produced by keeping, in a first stage during said aforementioned air bending, the plungers of the plunger-cylinder units 7 unpressurized in the lower and the upper dead centre positions, respectively. After execution of said air bending, the movement of the bending bar 3 is stopped before reaching the die bottom, and the plungers of the plunger-cylinder units 7 are pressurized. The bottom die is pressed under constant pressure against the sheet metal piece 8, deforming of which is therefore terminated under constant pressure. In this case too, it is necessary to take the stabilization measures described above if narrow sheet metal pieces are to be worked.

If there are any irregularities in the structure of sheet metal, bending is not effected with a constant pressure along the bending edge, but some of the plunger-cylinder units are differently pressurized. By this measure, the said irregularities in the structure of sheet metal are compensated for.

Figure 4:
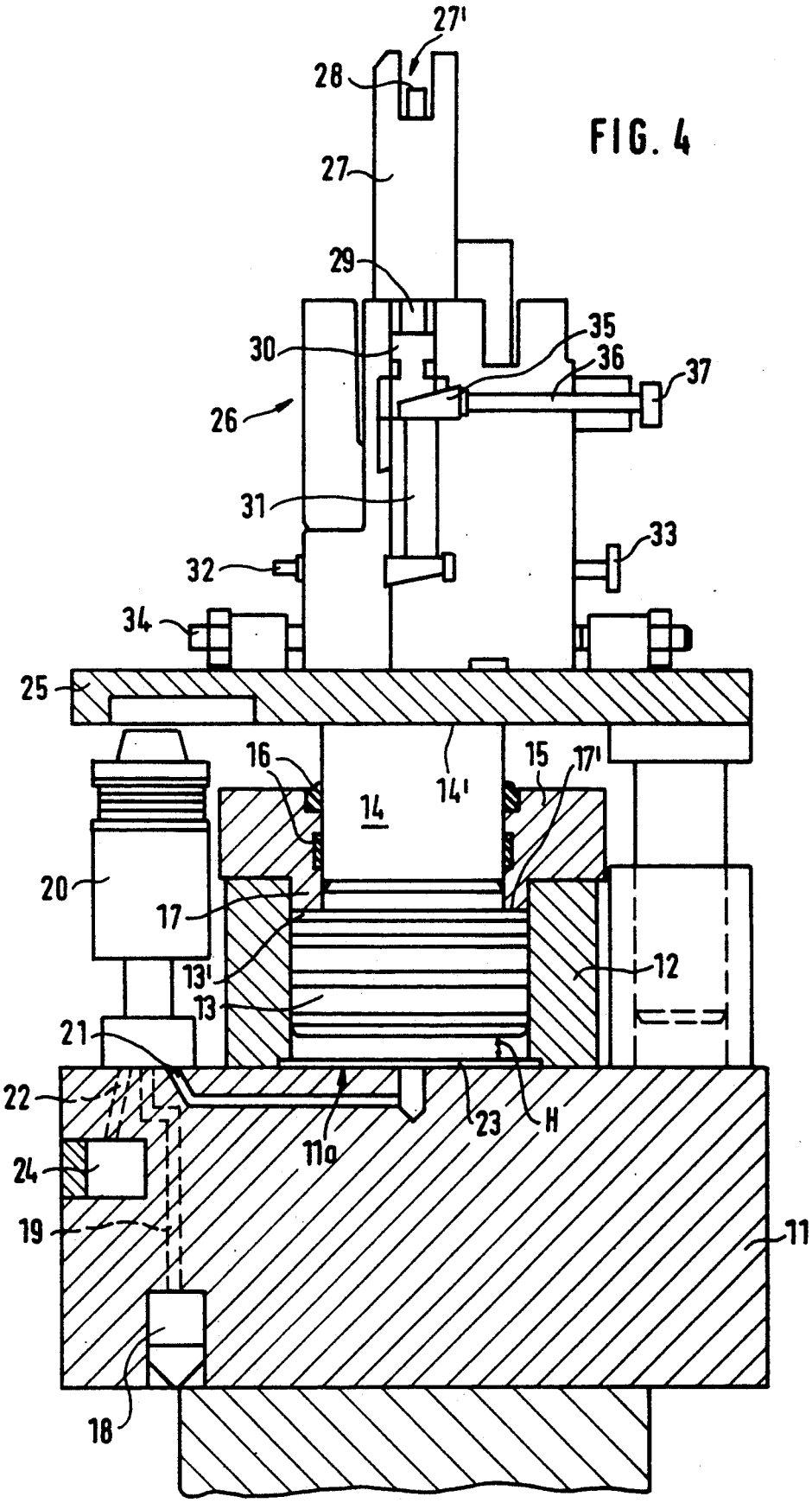
FIG. 4 is a more detailed sectional view of a bottom die with its bottom die holder and the plunger-cylinder unity arranged below them.

FIG. 4 shows an apparatus which is particularly suitable for performing the method of the invention, and particularly it shows, more in detail, the construction of the bottom die and the bottom die holder as well as of the plunger-cylinder units.

A number of plunger-cylinder units are closely arranged side by side on a stationary supporting plate 11, and said plunger-cylinder units extend in a right angle to the plane of projection and are provided each with a cylinder 12 comprising differential plungers 13, 14. The plunger part 13 is conveniently guided in the cylinder 12, whereas the plunger part 14, the diameter of which is smaller than that of the plunger part 13, is arranged in a top 15 of annular shape provided with packing rings 16. Further, the top 15 is provided with a ring extension 17 pointing downwardly which is extending into the interior of the cylinder 12, the edge 17' forming a stop for the upper dead centre position of the cylinder part 13. The lower stroke-limiting member is the corresponding surface 11*a* of the supporting plate 11. In this manner, a resulting plunger stroke equal to an amount H remains.

The stationary supporting plate 11 comprises a pressure conduit 18 which is connected to a pressure source.

A further pressure pipe 19 connects said pressure conduit 18 to a three-way valve 20, which latter in one position is connecting said pressure pipe 19 to a pipe 21, and in the other position is connecting said pipe 21 to a return conduit 24. Said pipe 21 leads into a hollow chamber 23 below said plunger part 13, whereas a pipe 22 serves as return pipe leading to said return conduit 24.

A common work table 25 is arranged above the plunger-cylinder units, said work table 25 being supported by the flat sides 14' of said plunger parts 14 of several plunger-cylinder units arranged side by side, and serving for containing a bottom die holder 26. Contained in said bottom die holder 26 is a bottom die 27 provided with an adjustable die bottom 28. Said die bottom 28 is preferably composed of pin inserts 29 which are contained in bores of said bottom die holder 26 and at their top jut out into a notch 27' of said bottom die 27. At their lower ends, said pin inserts 29 are supported by the surface of a support member 20 which is adjustable in height by means of a taper key 31. Displacement of said taper key 31 is effected by means of spindles 32 provided with regulating members 33. Said bottom die 27 together with said taper key adjusting unit is arranged on or in, respectively, said bottom die holder 26, which for its part is fixed on said one-piece work table 25 by means of a clamp member 34.

According to a variant, the bottom die holder 26 can be movable and adjustable in the horizontal plane, in order to permit the bottom die 27 to be displaced with respect to said ram 2 (not shown) by means of a displacement of said bottom die holder 26. This displacement can be effected by means of a spindle (not shown in detail).

A supplemental taper key system 35, actuated by a spindle 36 and a motor 37, is provided for raising those parts of said die bottom 28 which are situated at both ends of said bottom die 27, in order bridge the air gap caused by the sheet thickness, as explained above. This taper key system 35 is acting only against those of said pin inserts 20 which are situated at both ends of the bottom die 27 extending in a right angle to the plane of projection.

In a similar manner, it is possible to use a the taper key system for lowering said segments at both ends of a bending bar (not shown). This taper key system is similarly constructed as the system described and is not shown in FIG. 4.

The apparatus described permits an easy performing of the method of the invention: For pressurizing said differential plunger 13, 14, said pressure pipe 19 is connected to pipe 21 which runs into said hollow chamber 23 by means of said three-way valve 20. Said differential plunger 13, 14 is in its upper limit of travel, as shown in FIG. 4. Thereby, a shoulder 13' of said plunger part 13 will abut against said ring edge 17' of said ring extension 17. The pressure acting on said differential plunger 13, 14 in said hollow 23 is somewhat higher than the air bending force which is necessary for initially bending said work piece, so that said differential plunger 13, 14 remains in its upper dead centre position during the air bending process. When the bending bar (not shown) abuts against said die bottom 28 those of the differential plungers which are situated below said sheet metal piece 8 to be bent are pressed back. If the sheet metal piece 8 to be bent is shorter than the bottom die 27, the described stabilization measure become effective at both ends of said bottom die 27. Thereby, the two ends of said bending bar (not shown) abut against corresponding stops provided for compensation. The remaining differential plungers 13, 14, which are not situated below the sheet metal, are discharged. At the places concerned, either parts of the die bottom 28 are raised, or segments of said ram are lowered. In this way, a compensation of the thickness of the sheet metal piece is performed so that the folding press remains stable.

Another possibility is that in the starting position the differential plungers 13, 14 are kept unpressurized in their lower dead centre position. Air bending of the sheet metal piece is performed by means of the bending bar, whereby the ram is stopped before reaching the die bottom 28. After this, the plungers 13, 14 are pressurized in order to press the whole bottom die 27 together with the adjustable die bottom 28 against the sheet metal piece with an constant pressure. This produces a uniform deformation along the bending edge of the bending bar. During the whole operation, the die bottom 28 remains in the required position. Finally, it should be noticed that each differential plunger 13, 14 can be pressurized and controlled separately and independently from the others. This individual control allows to compensate for irregularities of the structure of the sheet metal piece to be bent by locally increasing or decreasing the pressure.

In the described embodiments of the invention, the bottom die holder is supported by a number of plunger-cylinder units lined up side by side. However, according to a further embodiment of the invention, it is possible to support the bending bar or the bending bar holder, respectively, by means of plunger-cylinder units lined up side by side.

Figure 5:
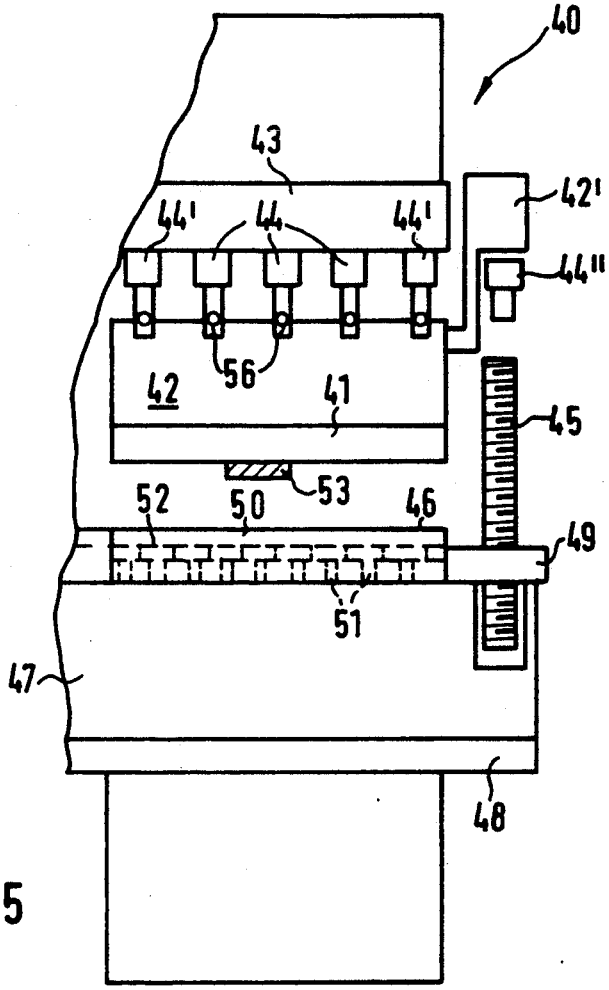
FIG. 5 is a diagrammatic view of a further variant of such a folding press.

Such a construction is diagrammatically shown in FIG. 5. The folding press 40 is provided with a bending bar 41 which is placed in a bending bar holder 42. Said bending bar holder 42 is connected to a ram 43 of said folding press 40 be means of plunger-cylinder units 44. The construction of said plunger-cylinder units 44 corresponds to that of the foregoing figure. One plunger-cylinder unit 44'' is arranged at each of the two lateral ends of said bending bar holder 42 in a holding arm 42'.

A bottom die 46 arranged in a bottom die holder 47 on a work table 48 is cooperating with said bending bar 41. One holding member 49 is arranged at each of the two ends of said bottom die 46 for receiving threaded spindles 45 which extend into the paths of the two plunger-cylinder units 41'. Said holding members 49 are adjusted synchronously with the vertically adjustable outermost bottom parts of said bottom die 46, as this is described below.

Figure 6:
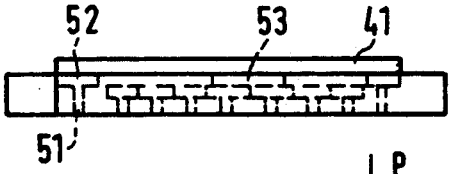
FIG. 6 shows the adjustable die bottom of the bottom die.
Figure 7:
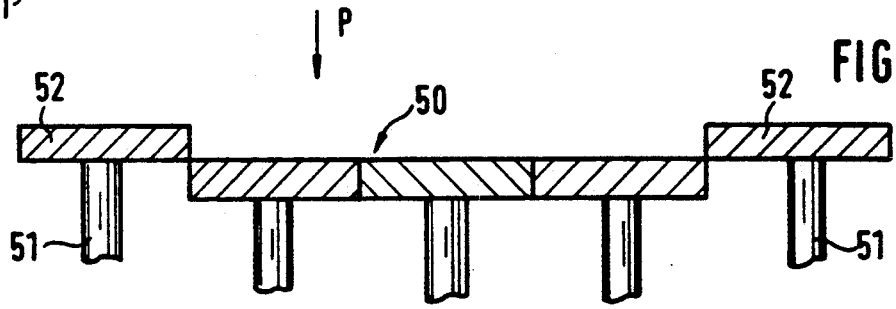
FIG. 7 shows an enlarged detail of FIG. 6.
Figure 8:
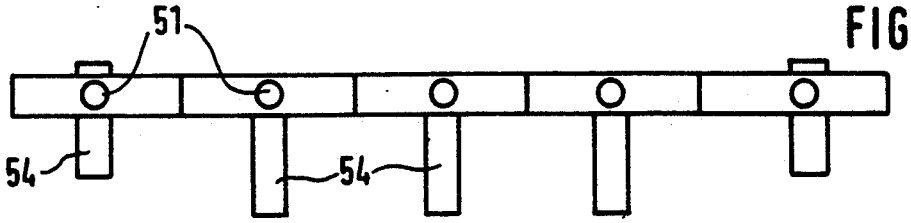
FIG. 8 is a view in the direction of the arrow in FIG. 7.

FIG. 5 shows said vertically adjustable die bottom 50, which is shown more in detail in FIGS. 6, 7 and 8. For said purpose, single pins 51 are inserted in corresponding bores of said bottom die holder 46. The upper ends of said pins 51 are suitably provided with tetragonal heads 52 which together form an even surface of the die bottom. FIG. 5 shows the starting position where all pins 51 take the same vertical position and their heads 52 define the even die bottom 50. The pins 51 are vertically adjustable by means of taper keys 54 which are horizontally adjustable, either commonly or separately. A diagrammatic view of FIG. 6 in the direction of arrow P is shown in FIG. 8. This figure shows that said taper keys 54 are displaceable in transverse direction Q below the lower ends of said pins 51 thereby causing a vertical displacement of said die bottom. FIGS. 6 and 7 show that the two outermost pins 51 provided with heads 52 take a higher position than the other ones. Said holding members 49 are adjusted synchronously with said pins.

Before starting the bending process, the adjustable bottom 50 of said bending die 46 is exactly vertically adjusted to the desired bending angle. For the initial air bending, the bending bar 41 is lowered towards the bottom die while said plunger-cylinder units 44 are pressurized with a pressure which is higher than the pressure necessary for air bending. When lowering said bending bar 41, the two lateral plunger-cylinder units 44', which are acting as stops, abut against the upper ends of the exactly adjusted threaded spindles 45. At this moment, air bending is finished, the leading bent edge of said sheet metal piece 53 abuts against the die bottom 50, and those plungers of said plunger-cylinder units 44 which are situated in the area of said sheet metal piece as well as the plungers of the two outermost situated plunger-cylinder units 44'' are pushed back.

Another possibility is to keep said plunger-cylinder units 44 unpressurized in their upper dead centre position and thereafter to stop said bending bar 41 before reaching the die bottom. Thereafter, the plungers of those plunger-cylinder units 44 which are above the sheet metal piece 53 as well as of the two outermost units 44' are pressurized so as to press said bending bar 41 with a constant pressure against said the bending edge or said stops 49, respectively.

A variant is shown in FIGS. 6 and 7. In this embodiment, there are no stops and no threaded spindles, but the die bottom 50 is raised in the areas left and right to the outermost plunger-cylinder units by an amount equal to the sheet thickness. This position is shown in FIG. 6 and in an enlarged scale in FIG. 7. Raising of the die bottom at the places concerned is effected by adjusting the corresponding taper keys 54 below the two outermost pins 51.

Figure 9:
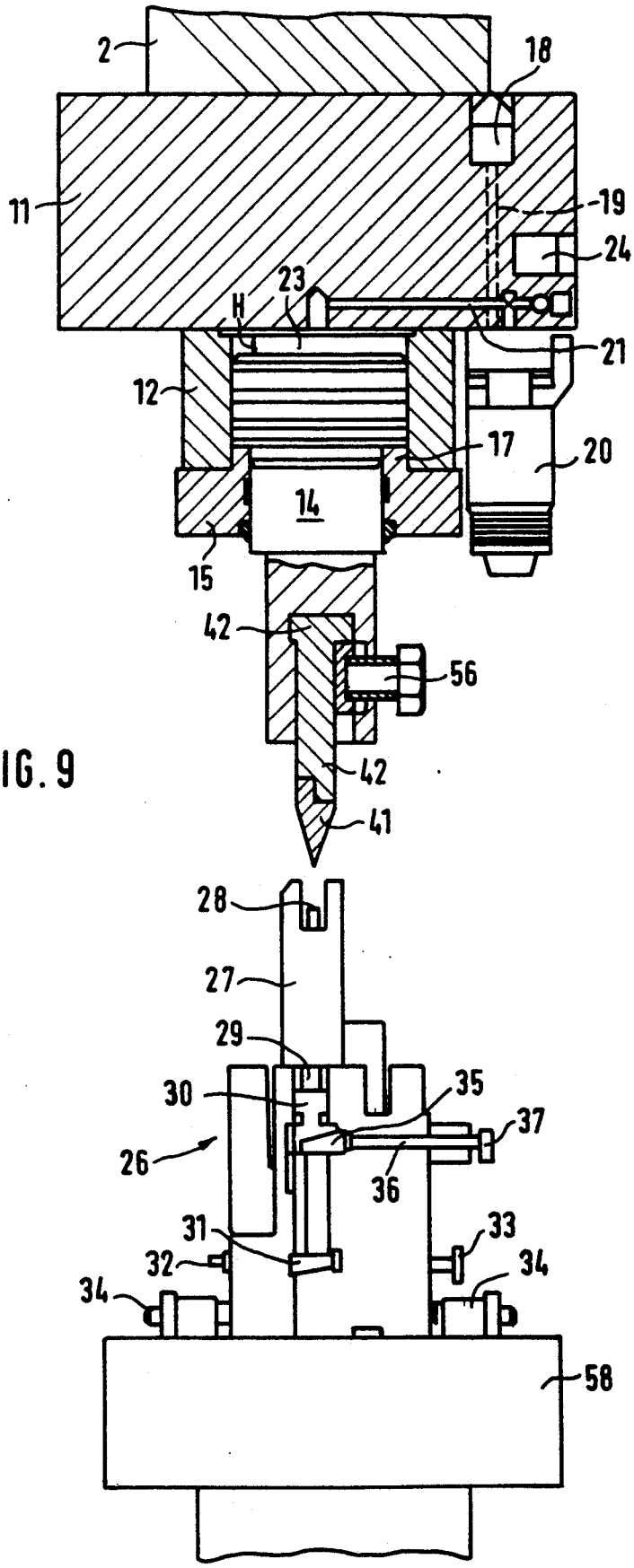
FIG. 9 is a sectional view of a bottom dies with its bottom die holder as well as of the bending bar and plunger-cylinder units arranged above them.

A more detailed view of the device described above is shown in FIG. 9. In this figure, the parts already shown in FIG. 4 are denoted by the same reference numbers.

The folding press shown in this Figure comprises a bottom die 27 provided with an adjustable die bottom 28 wherein pin inserts 29 are supported by a support member 30, said support member being adjustable by means of a taper key system 31 comprising a crosswisely arranged spindle 32 and a handwheel 37. These members are located in a bottom die holder 26 comprising —as already described—correcting taper keys 35 which are actuated by a spindle 36. A regulating member 37 is provided for this purpose. Said bottom die holder is fixed on said work table 56 by means of clamp members 34.

A bending bar 41 is cooperating with said bottom die 27, said bending bar 41 being fixed in a bending bar holder 42 by means of a fastening device 56 and arranged in plunger part 14 of said differential plunger 13, 14. Ram 2 of said folding press is provided with a supporting plate 11 on which a number of cylinders 12 are arranged side by side. A differential plunger 13, 14 is guided in each cylinder 12. These differential plunger 13, 14 commonly take up said bending bar holder 42 and said bending bar 41.

The function of this folding press was already described in detail with reference to FIGS. 5 to 8. The synchronous adjustment of said stops or said threaded spindle holding means, respectively, with said adjustable die bottom is not shown. This adjustment can be performed hydraulically, mechanically or electrically, and is known in the art.

What we claim is:

1. A method of bending a sheet metal piece by means of a bending apparatus, which apparatus comprises:

a bending bar holder for holding a bending bar;

a bending bar held in said bending bar holder;

a bending bottom die holder for holding a bending bottom die;

a bending bottom die placed in said bending bottom die holder and comprising an adjustable die bottom, said bending bottom die and said bending bar cooperating with each other to deform said sheet metal piece;

said bending bottom die and said bending bottom die holder, respectively, or said bending bar and said bending bar holder, respectively, being supported by a number of plunger-cylinder units arranged side-by-side; and said sheet metal piece being shorter than said bending bar and said bending bottom die;

said method comprising the steps of:

air bending said sheet metal piece in said bending bottom die;

further deforming said sheet metal piece along an elastic line on an edge of said bending bar and said die bottom, respectively, by cooperation of those of said plunger-cylinder units which are situated in an area of said sheet metal piece with said bending bottom die or said bending bar;

allowing plungers of two plunger-cylinder units which are arranged in left and right outermost positions outside said area of said sheet metal piece to abut against stops, said stops being arranged on both sides of said bending bottom die holder so as to bridge air gaps caused by said sheet metal piece missing at these places between said bending bar and said die bottom; and discharging remaining plungers which are situated outside said area of said sheet metal piece.

2. A method according to claim 1, comprising the steps of:

loading, before the bending process, all plunger-cylinder units with a pressure which is higher than air bending force;

moving the plungers toward an upper dead center position; and pressing back away from said upper dead center position, after termination of air bending when said bending edge of said sheet metal piece is abutting against said die bottom, the plungers situated within said area of said sheet metal piece as well as two outermost plungers of said plunger-cylinder units.

3. A method according to claim 1, comprising the steps of:

keeping said plunger-cylinder units unpressurized in lower and upper dead center positions, respectively, during air bending;

stopping said bending bar after air bending shortly before reaching said die bottom; and pressurizing those plungers of said plunger-cylinder units which are situated below and above said sheet metal piece, respectively, as well as two outermost plungers, in order to press said bending edge against said die bottom and to press said two outermost plungers against said stops.

4. A method according to one of claims 1 to 3 comprising the step of raising said die bottom within an area of the left and right outermost plunger-cylinder units, which area is situated outside said area of said sheet metal piece.

5. A method according to one of claims 1 to 3 comprising the steps of:

lowering, by the amount of a thickness of said sheet metal piece, those segments of said bending bar which are situated within an area of the left and right outermost plunger-cylinder units; and discharging remaining plunger-cylinder units which are situated outside said area of said sheet metal piece.

6. A method according to one of claims 1 to 3, comprising the step of raising or lowering the working pressure of said plunger-cylinder units at such places where local irregularities of structural or mechanical and strength properties, respectively, of said sheet metal piece occur, in order to compensate such local irregularities.

7. An apparatus for bending a sheet metal piece having a width which is smaller than the length of a bending bar and a bending die, said apparatus comprising:

a bending bar holder for holding a bending bar, said bending bar holder having two ends;

a bending bar held in said bending bar holder, said bending bar having two ends;

a bending bottom die holder for holding a bending bottom die;

a bending bottom die located in said bottom die holder, said bending bottom die including an adjustable die bottom, said bending bottom die and said bending bar cooperating with each other to deform the sheet metal piece, said die bottom and said bending bar defining air gaps therebetween when the sheet metal piece is being deformed, the size of the air gaps corresponding to the thickness of the sheet metal piece;

a number of pressurizable plunger-cylinder units arranged side-by-side and positioned relative to said bending bottom die holder for supporting said bending bottom die holder when said bending bottom die and said bending bar are cooperating with each other to deform the sheet metal piece, the pressure in each of said plunger-cylinder units being independently controllable to vary the amount of support against a corresponding portion of said bending bottom die holder and to thereby vary the amount of resistance against said bending bar when said bending bottom die and said bending bar are cooperating with each other to deform the sheet metal piece; and adjustable means arranged at both ends of said bending bar for, when adjusted to the thickness of the sheet metal piece, bridging the air gaps corresponding to the thickness of the sheet metal piece;

said adjustable means including holding members located at both ends of said bending bar and adjustable stops arranged in said holding members;

said adjustable means including counter-stops located at both ends of said bending bottom die holder, said counter-stops being synchronously movable together with said die bottom, said counter-stops cooperating with said adjustable stops to bridge the air gaps defined between said die bottom and said bending bar.

8. An apparatus according to claim 7, wherein said adjustable stops are adjustable threaded spindles bridging the air gaps at both ends of said bending bar.

9. An apparatus for bending a sheet metal piece having a width which is smaller than the length of a bending bar and a bending die, said apparatus comprising:

a bending bar holder for holding a bending bar, said bending bar holder having two ends;

a bending bar held in said bending bar holder, said bending bar having two ends;

a bending bottom die holder for holding a bending bottom die;

a bending bottom die located in said bottom die holder, said bending bottom die including an adjustable die bottom, said bending bottom die and said bending bar cooperating with each other to deform the sheet metal piece, said die bottom and said bending bar defining air gaps therebetween when the sheet metal piece is being deformed, the size of the air gaps corresponding to the thickness of the sheet metal piece;

a number of pressurizable plunger-cylinder units arranged side-by-side and positioned relative to said bending bar holder for supporting said bending bar holder when said bending bottom die and said bending bar are cooperating with each other to deform the sheet metal piece, the pressure in each of said plunger-cylinder units being independently controllable to vary the amount of support against a corresponding portion of said bending bar holder and to thereby vary the amount of resistance against said bending bottom die when said bending bottom die and said bending bar are cooperating with each other to deform the sheet metal piece; and adjustable means arranged at both ends of said bending bar for, when adjusted to the thickness of the sheet metal piece, bridging the air gaps corresponding to the thickness of the sheet metal piece;

said adjustable means including holding members located at both ends of said bending bar and adjustable stops arranged in said holding members;

said adjustable means including counter-stops located at both ends of said bending bottom die holder, said counter-stops being synchronously movable together with said die bottom, said counter-stops cooperating with said adjustable stops to bridge the air gaps defined between said die bottom and said bending bar.

10. An apparatus according to claim 9, wherein said adjustable stops are adjustable threaded spindles bridging the air gaps at both ends of said bending bar.

* * * * *